US008136537B2

(12) United States Patent
Cerrano et al.

(10) Patent No.: US 8,136,537 B2
(45) Date of Patent: Mar. 20, 2012

(54) ACTUATION DEVICE

(75) Inventors: Michele Cerrano, Casale Monferrato (IT); Franco Musso, Casale Monferrato (IT); Daniele Sforzin, Casale Monferrato (IT)

(73) Assignee: ELTEK S.p.A., Casale Monferrato (Alessandria) (IT)

( * ) Notice: Subject to any disclaimer, the term of this patent is extended or adjusted under 35 U.S.C. 154(b) by 793 days.

(21) Appl. No.: 12/188,758

(22) Filed: Aug. 8, 2008

(65) Prior Publication Data

US 2009/0038662 A1 Feb. 12, 2009

(30) Foreign Application Priority Data

Aug. 9, 2007 (IT) ..... TO2007A0597

(51) Int. Cl.
*B08B 3/00* (2006.01)

(52) U.S. Cl. ..... 134/93; 134/56 D; 134/57 D; 134/58 D

(58) Field of Classification Search ..... 134/56 D, 134/57 D, 58 D, 93
See application file for complete search history.

(56) References Cited

U.S. PATENT DOCUMENTS 7,823,236 B2 * 11/2010 Cerruti ..... 8/147
7,934,623 B2 * 5/2011 Cerruti ..... 222/129

FOREIGN PATENT DOCUMENTS

WO WO2007017749 A1 2/2007
WO WO 2007017749 A1 * 2/2007

* cited by examiner

*Primary Examiner* — Michael Barr
*Assistant Examiner* — Charles W Kling
(74) *Attorney, Agent, or Firm* — Heslin Rothenberg Farley & Mesiti P.C.; Victor A. Cardona, Esq.

(57) ABSTRACT

An actuation device includes a driving member, a driven member and an actuating arrangement operable for producing a movement of the driving member. The driven member has a seat into which is operatively inserted, with the possibility of relative movement, an engagement part of the driving member. The driving member has a seat which, in at least one position of the actuation device, at least partially faces the seat of the driven member. The two seats are longitudinally extended and the actuation device further includes at least one floating body, capable of moving between the two seats when they face each other at least in part. The driving member and the driven member are configured for preventing accidental or irregular displacements of the floating body, particularly accidental or irregular displacements due to knocks, vibrations and similar mechanical stresses.

21 Claims, 12 Drawing Sheets

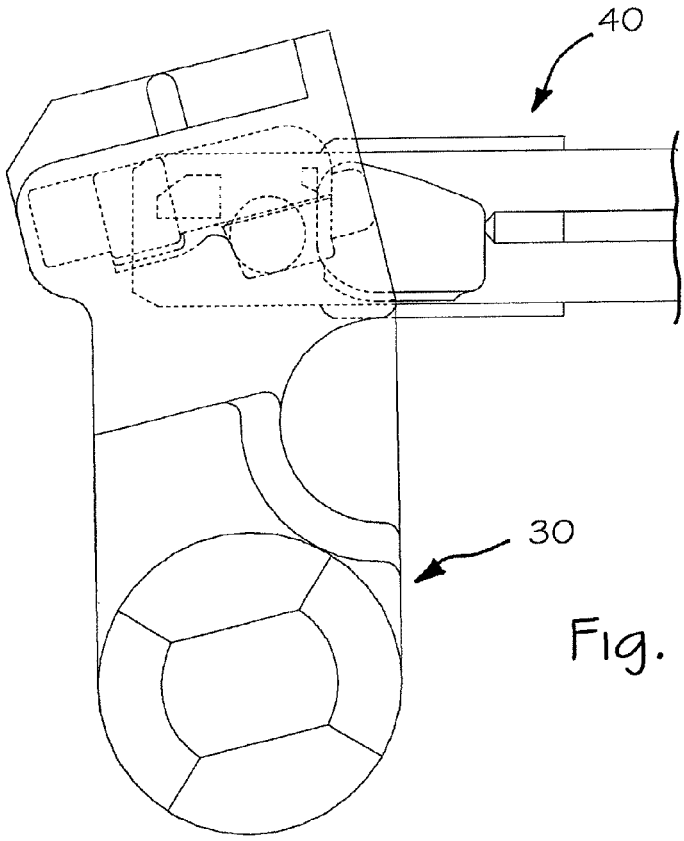
Fig. 15
Fig. 16
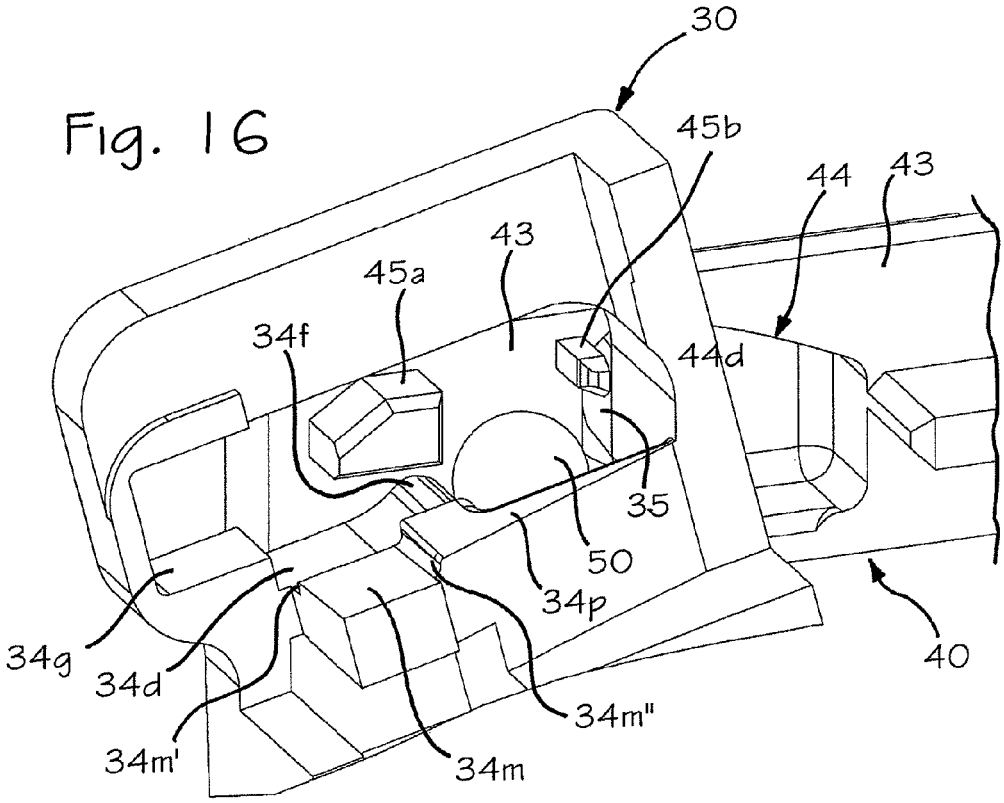

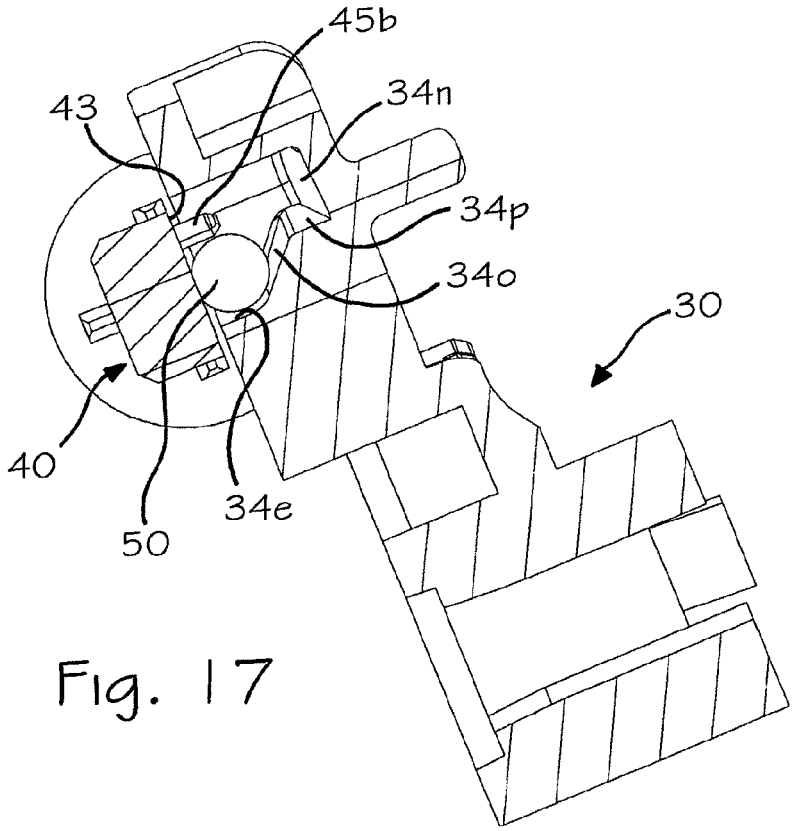
Fig. 17
Fig. 18
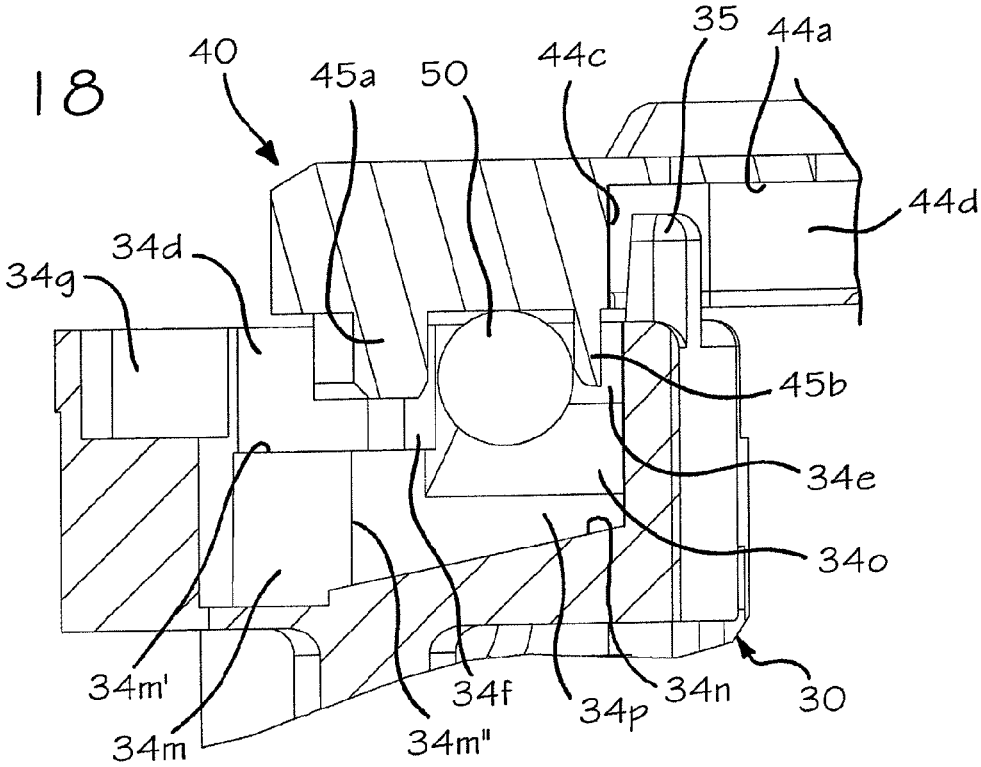

ACTUATION DEVICE

CROSS-REFERENCE TO RELATED APPLICATIONS

This application claims priority from Italian patent application Serial No. TO2007A000597, filed on Aug. 9, 2007, the entirety of which is hereby incorporated by reference.

FIELD OF THE INVENTION

The present invention relates to actuation devices having a driving member, a driven member and actuating means which are operable for causing a movement of the driving member. The invention has been developed with particular reference being paid to devices wherein the predetermined movement of the driving member is capable of selectively causing strokes of differing magnitude of the driven member.

BACKGROUND ART

A device having the features referred to above is known from document WO 2007/017749 in the name of the same Applicant: reference can be made to the introductory part of said document, also concerning the general state of the art. The device described in the earlier document proves itself to be effective, compact, little subject to wear, inexpensive and generally reliable. It was however found that, in particularly critical conditions of use, the operation of the device can be subject to errors. The operation of the device is in fact based on the use of a floating body, which is capable of moving between two housings, formed in the driving member and the driven member of the actuation device, respectively. It has been found, for example, that the operation of the device can be affected occasionally by violent knocks suffered by the component to which the device itself is attached, such as for example a generic door: a violent impact to the above component is in fact transmitted to the actuation device, with the risk of causing an accidental and undesired movement of the floating body, and therefore an error in the operating cycle of the device.

SUMMARY OF THE INVENTION

The present invention proposes mainly to solve the above drawback, by creating a device of the type indicated, of increased reliability, capable of bearing harsh conditions of use distinguished by knocks, blows, shaking, vibration and similar stresses, even of considerable magnitude, imparted directly or indirectly to the device itself.

This object is achieved, according to the present invention, by an actuation device having the features as in the attached claims, which constitute an integral part of the technical teaching provided herein in relation to the invention.

BRIEF DESCRIPTION OF THE DRAWINGS

Further aims, characteristics and advantages of the invention will become clear from the detailed description which follows and from the attached drawings, provided purely by way of explanatory and non-limiting example, in which:

FIGS. 15-18 are views similar to those in FIGS. 11-14, but with the device in a second condition;

DESCRIPTION OF PREFERRED EMBODIMENTS OF THE INVENTION

In the example which follows the actuation device which is the subject of the invention will be described with reference to an advantageous application thereof, i.e., for controlling the operation of a washing agent dispenser for a dishwashing machine. The device according to the invention is in any case also capable of use in other fields, similarly to what is specified in WO 2007/017749.

Figure 1:
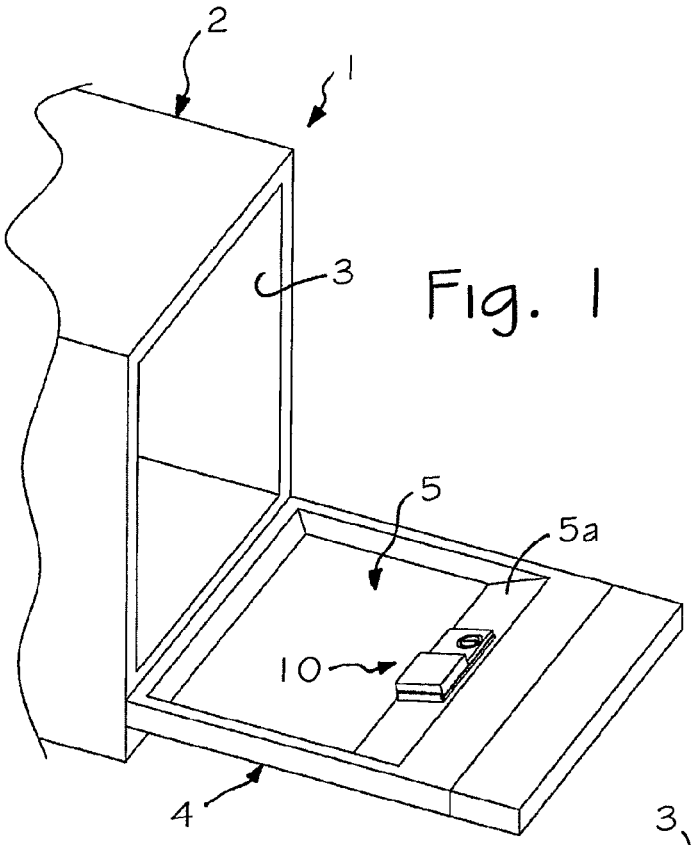
FIG. 1 is a partial perspective view of a dishwasher with the door open, equipped with a washing agent dispenser which incorporates an actuation device according to the invention.

In FIG. 1, reference 1 designates as a whole a dishwasher, comprising a cabinet or structure 2, inside which there is a washing chamber 3. Cabinet 2 has associated thereto a door 4, hinged at the bottom to cabinet 2, so as to be able to rotate around a substantially horizontal axis. The surface of door 4 which is designed to frontally delimit the washing chamber 3—i.e. the so-called "door liner"—has a shaped or drawn area 5, comprising an inclined wall portion 5*a*, in which an opening is formed, which partially houses in a sealingly manner a washing agent dispenser, designated by 10.

Figure 3:
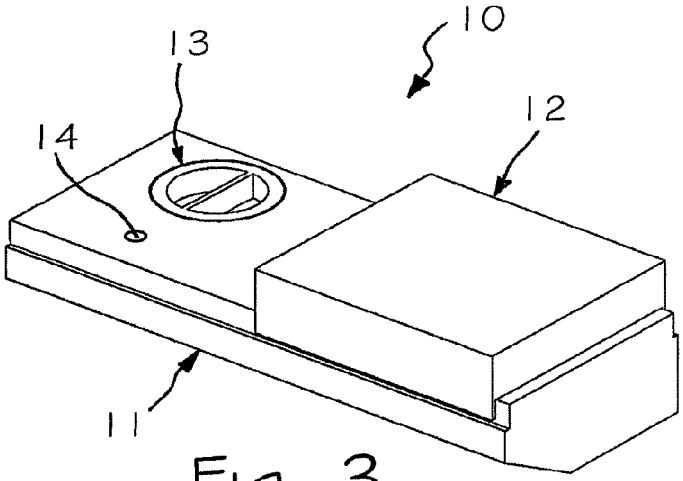
FIGS. 3 and 4 are schematic perspective views, from two different angles, of a washing agent dispenser which uses an actuation device according to the invention.

The dispenser 10 comprises two delivery arrangements for different washing agents, and in particular a delivery arrangement for a detergent in solid form, in powder or as a tablet, and a delivery arrangement for a liquid additive, or rinse aid; in what follows, the first and the second delivery arrangement will for simplicity be designated "detergent delivery arrangement" and "rinse aid delivery arrangement" respectively. As may be seen in FIG. 3, the dispenser has a main body 11, for example including at least two pieces in thermoplastic material welded together. As in the prior art, in the front piece of body 11 a compartment is formed for containing detergent, not visible, to which a respective lid 12 is functionally associated, here of the type mounted slidably on the body 11 and capable of movement between an open position and a closed position, only the latter being represented in the drawings. Note that the lid 12 could also be of a different type, for example configured as a tilting or rotating flap, or guided or hinged to the body 11, according to known art. Inside the body 11, a tank is defined for the liquid rinse aid, not visible, in communication both with a loading opening, provided with a removable cap, designated by 13, and with a delivery opening 14.

Figure 4:
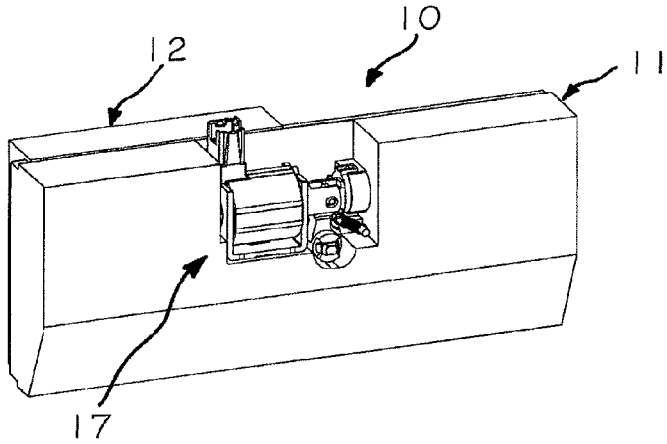
Figure 5A:
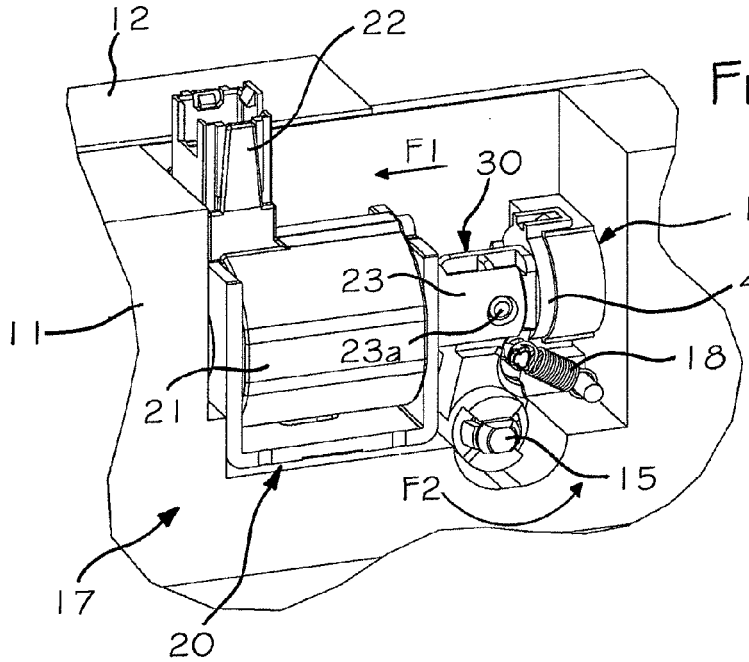
FIG. 5*a* is an enlarged detail of FIG. 4, relating to the actuation device according to the invention.

The dispenser 10 is provided with a hooking/unhooking device, arranged for locking the lid 12 in the respective closed position and subsequently unlocking it, in order to allow it to open as a result of the action of elastic means, when the detergent is to be delivered. The dispenser 10 is furthermore provided with a valve device, for controlling the delivery of the rinse aid. The devices mentioned above are of a design known in the field and they will therefore not be described in detail; here it should be sufficient to state that, in the embodiment illustrated:

- the above-mentioned hooking/unhooking device comprises a small rotatable shaft, designated by 15 in FIG. 5*a*, which passes through the body 11 and which carries, at a first end, a hooking member adapted to cooperate with a respective hooking member on lid 12, not visible; the second end of the shaft is operatively connected to an actuation device, designated as a whole by 17 in FIGS. 4 and 5*a*, located in the rear part of body 11 and capable of bringing about rotation of the shaft itself around its own axis, under the control of the timer of machine 1;
- the above-mentioned valve device, a part of which is designated as a whole by 16 in FIG. 5*a*, is selectively operable to cause emission from the opening 14 of at least one dose of rinse aid; also the above-mentioned valve device is actuated by means of the above said actuation device 17, under the control of the timer of the machine 1; possibly, the valve device can be connected to a known reservoir or other metering system inside the body 11, in communication with the rinse aid tank and with opening 14.

Figure 2:
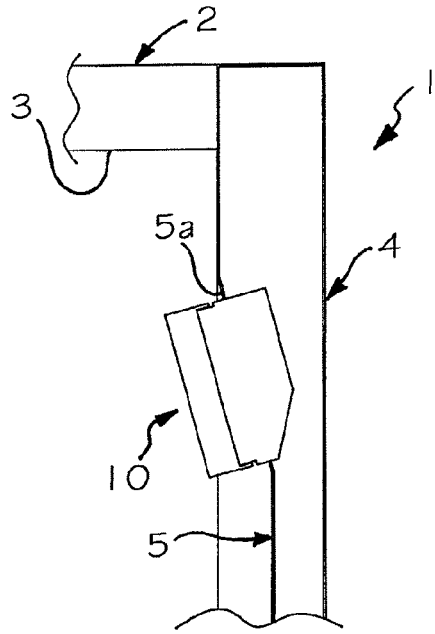
FIG. 2 is a schematic section of a part of the washing machine of FIG. 1, with the door closed.

In FIG. 1 door 4 is represented in the open position. In this condition, the compartment designed for containing the detergent and the aperture for accessing to the rinse aid tank are accessible from above, for the normal operations of loading the washing agents. In FIG. 2 on the other hand, door 4 is represented in the closed position. In this condition, following opening of the lid 12 of the dispenser 10, the detergent is free to fall by gravity into the chamber 3; similarly, following the actuation of the above-mentioned valve device for delivering the rinse aid, the liquid washing agent can exit from body 11 through the opening 14 and flow into the chamber 3.

As has been mentioned, the shaft forming part of the hooking/unhooking system of the detergent delivery arrangement, and the valve device forming part of the rinse aid delivery arrangement, are actuated by means of one and the same actuation device, designated as a whole by 17 in FIG. 4, which constitutes the specific subject of the present invention. The actuation device 17, represented on a larger scale in FIG. 5*a*, comprises a single actuator, designated as a whole by 20: in the case illustrated, the actuator 20 is a solenoid actuator, well-known in the field, and as such not needing a detailed description. Here it should be sufficient to state that:

- the actuator 20 comprises an inductor winding or coil 21, having associated thereto a connector 22 for the electrical supply, such as a Rast 2.5 connector, and a movable core 23;
- following supplying of the coil 21, the core 23 is attracted by the coil 21, or induced to move in a linear direction, substantially coinciding with or parallel to the direction indicated by the arrow F1, against the action of at least one elastic means.

It is obviously possible to use actuating means of other types, as described in WO 2007/017749, such as for example a thermal or thermo-actuator.

The movable core 23 has a respective end which projects permanently from the coil 20 and is operatively constrained, in the example by means of a pin element 23*a*, to a driving member. In the case exemplified, this driving member consists of a lever, designated as a whole by 30, angularly movable, as indicated by the arrow F2. The lever 30 is keyed, at its lower end, to the shaft 15, forming part of the hooking/unhooking device for the lid 12.

The lever 30 is operatively constrained, in an intermediate region thereof, to a driven member.

Figure 5B:
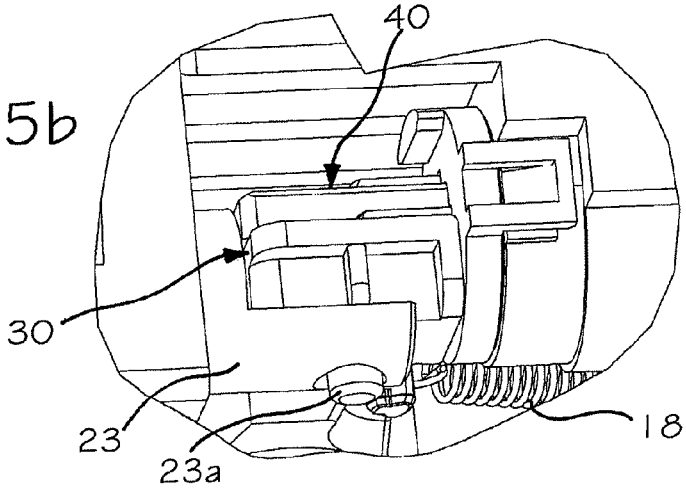
FIG. 5*b* is a perspective view from above of a part of the actuation device of FIG. 4.

In the exemplified case, this driven member consists of a rod or slider, designated by 40 in FIG. 5*b*, which is linearly slidable in a direction parallel to the movable core 23, or in the direction indicated by the arrow F1; this rod 40 is associated or is a part of the above-mentioned valve device 16, which device 16 is in turn part of the rinse aid delivery arrangement. As may be inferred, the arrangement is such that, following electrical power being supplied to the coil 21, with the consequent withdrawal or traction of the movable core 23 in the direction indicated by the arrow F1, the lever 30 is subjected to an angular movement in the direction indicated by the arrow F2 of FIG. 5*a*, against the elastic reaction of a spring 18, interacting between the lever itself and the main body 11, of the dispenser.

Figure 6:
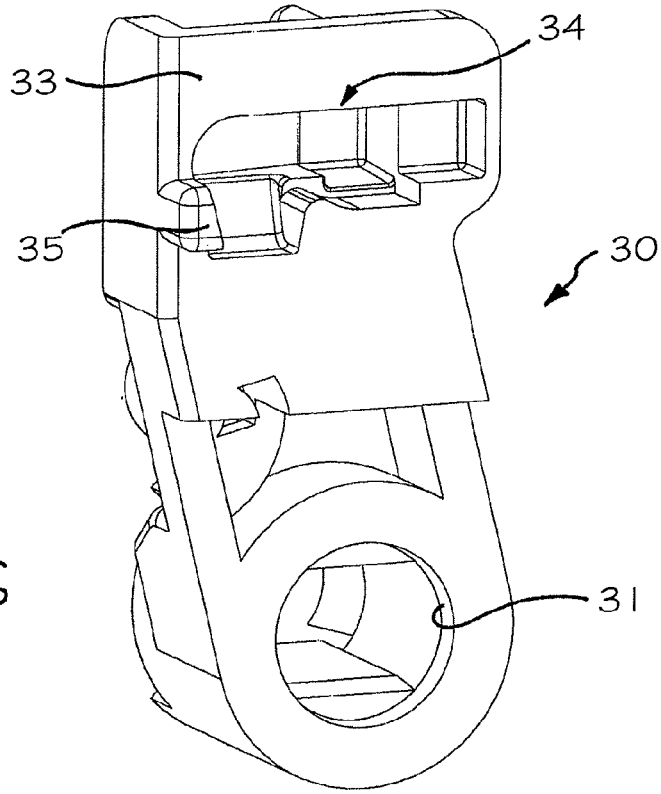
FIGS. 6 and 7 are a perspective view and a corresponding enlarged detail of a driving member of the actuation device of FIG. 5*a;*

As may be seen in FIG. 6, the lever 30 has, in the lower zone thereof, a shaped passageway 31 to allow it to be keyed to the shaft 15. In the upper zone the lever 30 has a region having a flat wall or surface 33. In this region a shaped recess is defined, which form a longitudinally extended seat, designated as a whole by 34, which seat is open at the above said surface 33, hereinafter referred to as front surface. From this front surface 33 there also projects an engagement part 35, configured as a suitably shaped projection or relief. This part 35 is preferably an integral part of lever 30, for example formed by moulding in a single piece, but can also be conceived as an independent element attached to the lever (for example by fitting together, or joining by adhesive, welding or other known technique). Also the pin element 23*a*, for the coupling to the movable core, can be defined by the body of the lever 30 or configured as a distinct component associated to the lever.

Figure 7:
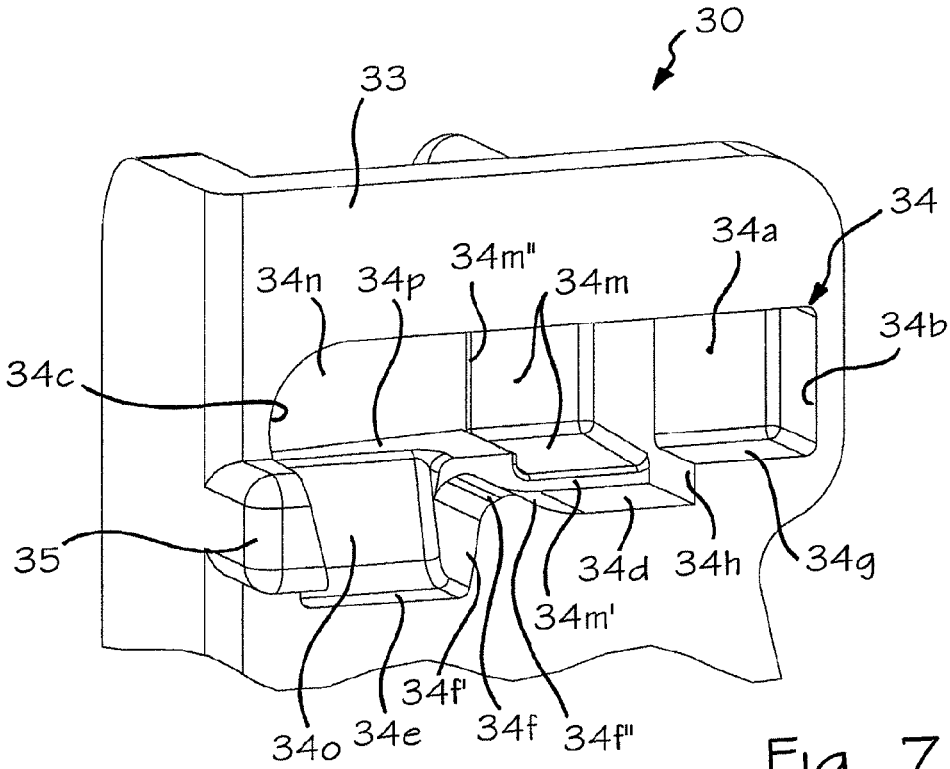

As may be seen in FIG. 7, seat 34 is substantially configured as a blind cavity, having a bottom 34*a* and a peripheral profile in which it is possible to identify an upper surface, not indicated, two longitudinal end surfaces 34*h*, 34*c*, and a lower surface. This lower surface is shaped so as to define a first portion, substantially flat or slightly inclined, designated by 34*d*, and a second substantially flat or slightly inclined portion 34*e*, the second portion lying at a lower height than the first portion. Between the surface portions 34*d* and 34*e* there is a step forming a cusp 34*f*, preferably at least partly rounded. Between the cusp 34*f* and the surface portion 34*d* a first step surface extends, designated by 34*f'*, and between the cusp 34*f* and the surface portion 34*e* a second step surface extends, designated 34*r'*, these two step surfaces being inclined in opposite directions.

The lower surface of seat 34 has furthermore a third portion 34*g*, here substantially flat, at a greater height than the first portion 34*d*, with another step, designated by 34*h*, being formed between portions 34*d* and 34*g* of the lower surface. From FIG. 7 it may also be noted that, in the exemplified case, projection 35 has an "active" side surface substantially in common with the longitudinal end surface 34*c* of the seat 34

Figure 10:
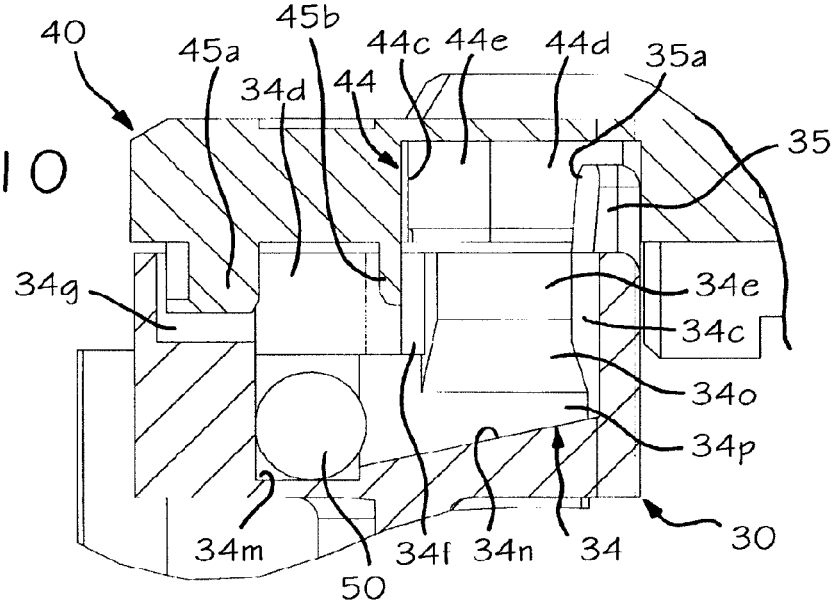
FIG. 10 is a schematic cross section of parts of interest of the actuation device according to the invention, in a reset condition (or in a condition of the dishwasher door being open, as in FIG. 1)

(this surface of projection 35—designated by 35*a* in FIG. 10—is preferably slightly inclined with respect to surface 34*c*).

From FIGS. 7 and 10 the conformation of the shaped bottom 34*a* of seat 34 can be inferred, which includes an intermediate recess 34*m*, formed in the bottom itself, substantially in line with the lower surface portion 34*d*, also forming a small step 34*m*' with respect to the latter. The bottom 34*a* furthermore has a region with a curved and inclined profile—which extends substantially between recess 34*m* and surface portion 34*e*, meeting up with the latter, which is defined in its turn by two portions 34*n* and 34*o*, which are separated from each other by a step 34*p*. It will be noted, for example in FIG. 7, that the depth of the seat 34—to be meant as the distance between the plane of the front surface 33 and the surfaces forming the bottom 34*a*—is different in different zones within the seat. In particular, the portion of the bottom 34*a* which is in correspondence with the lower surface portion 34*g* is substantially parallel to the front surface 33, at a first distance; the bottom of recess 34*m* is also substantially parallel to the front surface 33, but at a second distance thereto, greater than the aforesaid first distance; the bottom portion 34*n* begins, starting from a respective side of the recess 34*m*, at a third distance from surface 33, which is between the aforesaid first and second distances, this third distance decreasing until the end surface 34*c*; the bottom portion 34*o*, on the other hand, begins starting from the step 34*p*, at a fourth distance from surface 33, which is between the aforesaid first and third distances, this fourth distance decreasing until the lower surface portion 34*e*. All in all, therefore, the bottom of the recess 34*m* defines the point of greatest depth of the seat 34, with respect to the front surface 33 of the lever 30, while the bottom portions 34*n* and 34*o* define a section of seat 34 having a decreasing depth, again with respect to the front surface 33 of the lever 30. With this conformation, furthermore, between the bottom of recess 34*m* and surface 34*n*, a further small step is defined, designated by 34 *m*" in FIG. 7.

Figure 8:
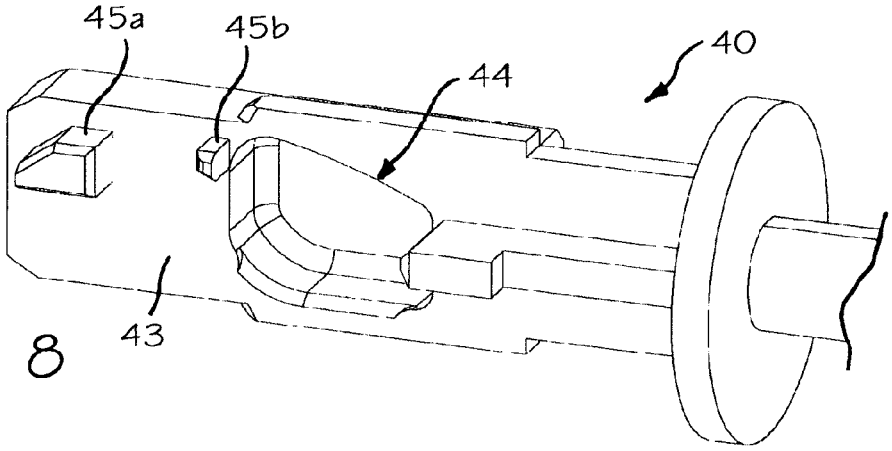
FIGS. 8 and 9 are a perspective view and a corresponding enlarged detail of a driven member of the actuation device shown in FIG. 5*b;*

The rod 40 protrudes from an opening formed in a cover 41, which is sealingly hooked to a portion of body 11 of the dispenser. As may be seen in FIG. 8, in the region of the rod 40 which protrudes from the cover 41, a substantially flat surface 43 is defined, hereinafter referred to as front surface, and in this region a shaped recess is formed, which creates a seat designated as a whole by 44, longitudinally extended and open at the front surface 43. Seat 44 has a development which is partly inclined upwards, and dimensions such as to be able to receive, with the possibility of movement, at least part of projection 35 of the lever 30, as will become clear below. From the front surface 43 of lever 40, furthermore, two constraining parts protrude, configured as reliefs or projections, indicated by 45*a* and 45*b*, permanently received or inserted, at least in part, within seat 34. In the example illustrated, projection 45*a* has a greater volume than projection 45*b*. Both projections 45*a* and 45*b* are located in an area of the front surface 43 which, in the various operating positions of the actuation device 17, is designed to be at least in part facing the seat 34 of lever 30. Projections 45*a* and 45*b* are spaced apart in a direction substantially parallel to the axis of rod 40, or to its direction of movement F2, in order to delimit between them a zone of constraint for a floating body, which will be described below. Similarly to projection 35 of lever 30, also projections 45*a* and 45*b* also can be an integral part of the rod 40, for example formed by moulding in a single piece, or can be independent elements attached to the rod itself.

Figure 9:
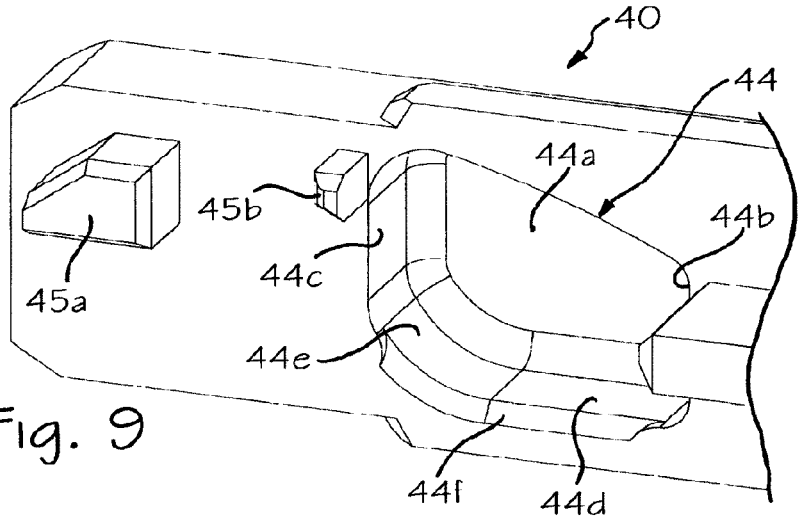

As may be seen in FIG. 9, also seat 44 is substantially configured as a blind cavity, having a bottom 44*a*, substantially flat or in part slightly inclined (see also FIG. 10) and a peripheral profile in which it is possible to identify an upper surface, not indicated, two longitudinal end surfaces 44*b* and 44*c*, and a lower surface. This lower surface has a substantially flat portion, indicated by 44*d*, and an inclined or curved or radiused portion 44*e*, which rises from portion 44*d* until it meets the longitudinal end surface 44*c*, the latter being higher than the other end surface 44*b*. Possibly, although this is not strictly necessary, between at least part of the bottom surface 44*d*-44*e* of seat 44 and the front surface 43 of rod 40, a bevel or ramp, marked 44*f* only in FIG. 9, can be provided, inclined in a transverse direction with respect to the development of said lower surface 44*d*-44*e*.

The lever 30 and the rod 40, with the respective seats 34 and 44, can conveniently be formed of thermoplastic material by moulding operations, simply and economically.

The actuation device according to the invention further comprises a floating body, designated by 50 in FIG. 10 and the subsequent figures, having dimensions such as to be adapted to be received alternatively in seat 34 and seat 44, with the possibility of being selectively moved between the seat themselves, which are configured for the purpose; the floating body 50 is designed for assuming various positions within at least one of the seats 34 and 44 as a result of successive actuations of the actuating means 20 and/or of movements imparted to the device 17. As will also become clear below, the term "floating" is to be understood here to indicate that body 50 is not joined to other parts of the device, notwithstanding the fact that, as we have said, the floating body is housed alternatively in seats 34 and 44.

Figure 22:
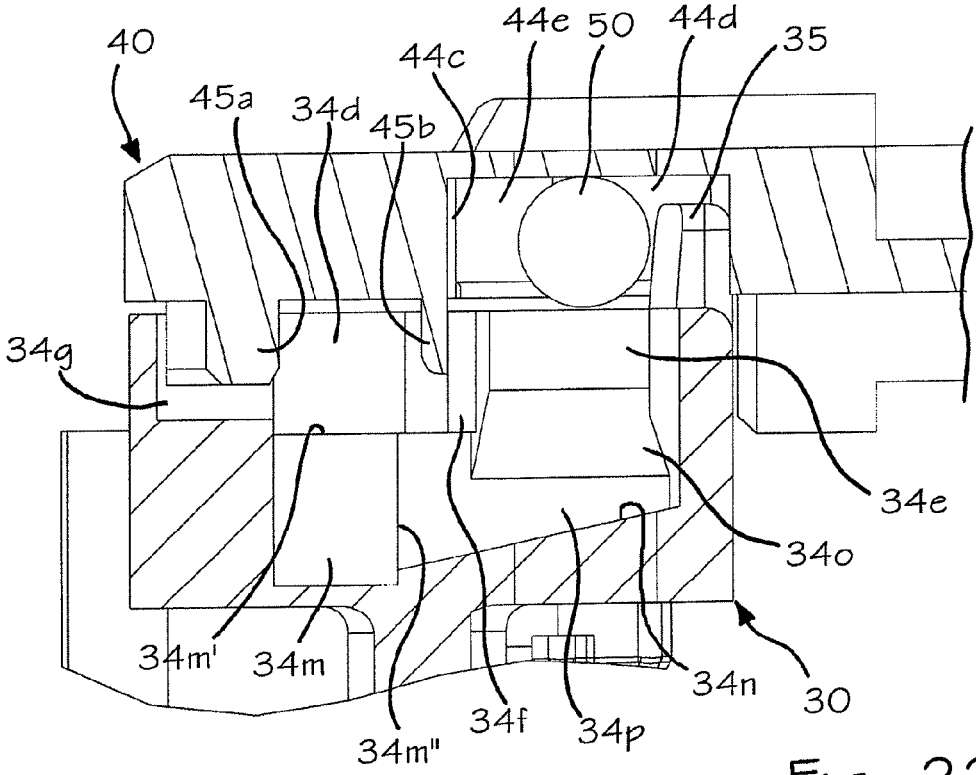
Figure 23:
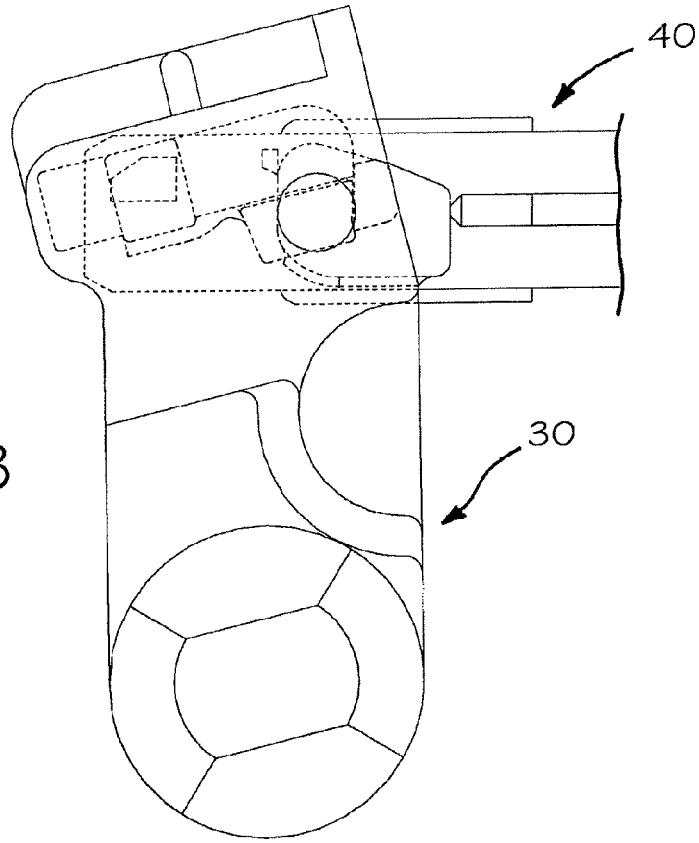
FIGS. 23-26 are views similar to those in FIGS. 11-14, but with the device in a fourth condition.
Figure 24:
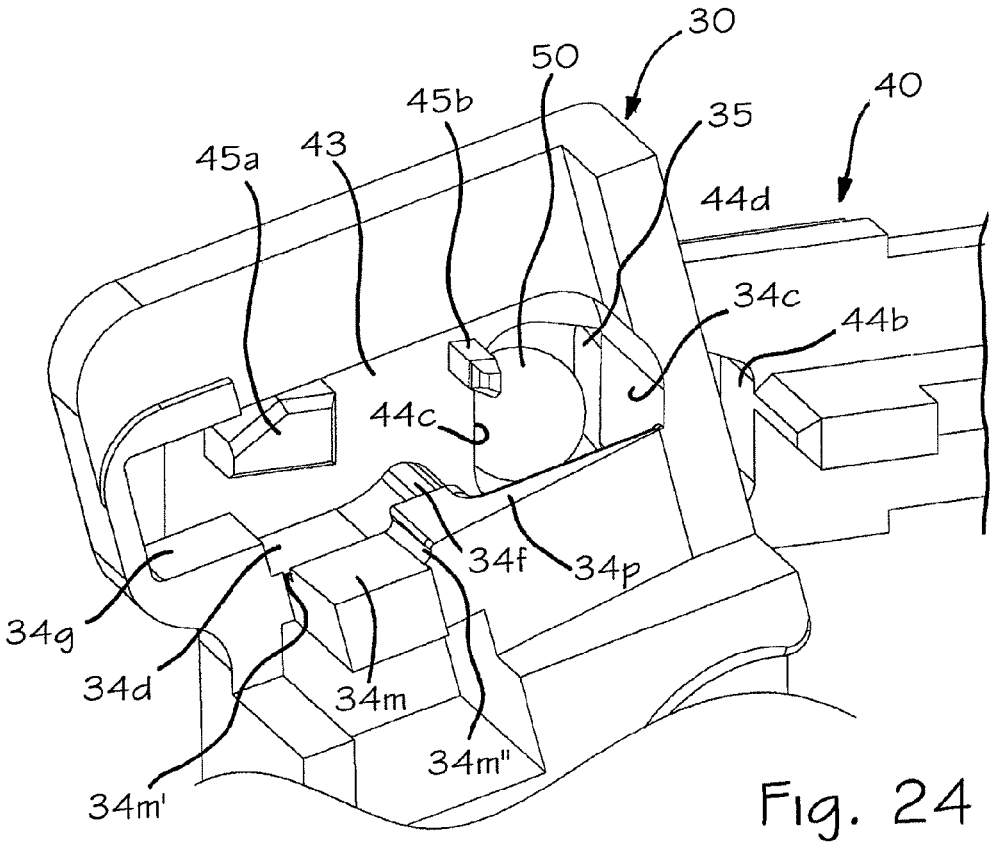
Figure 25:
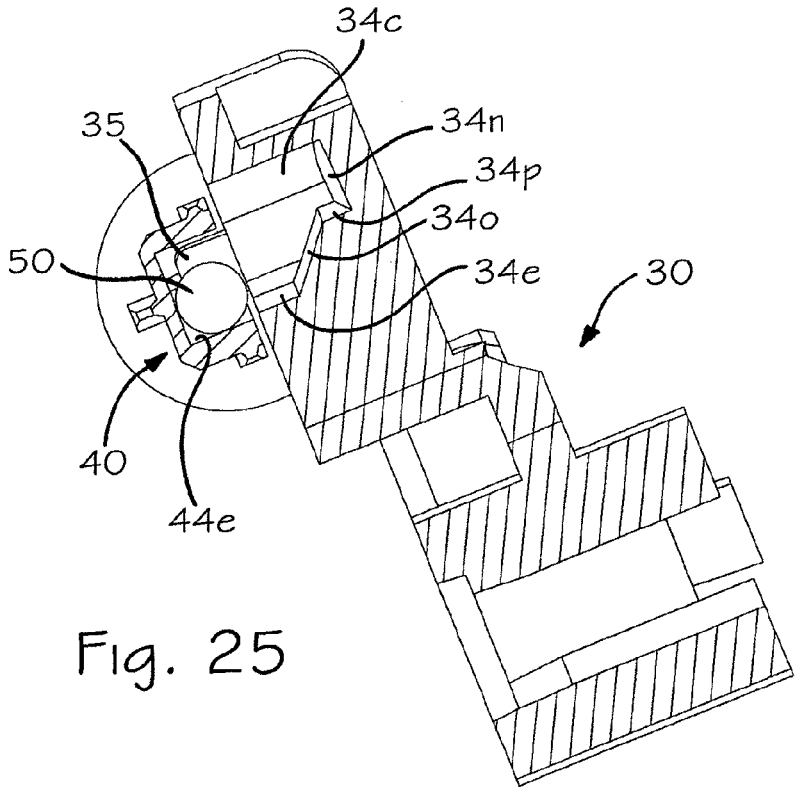
Figure 26:
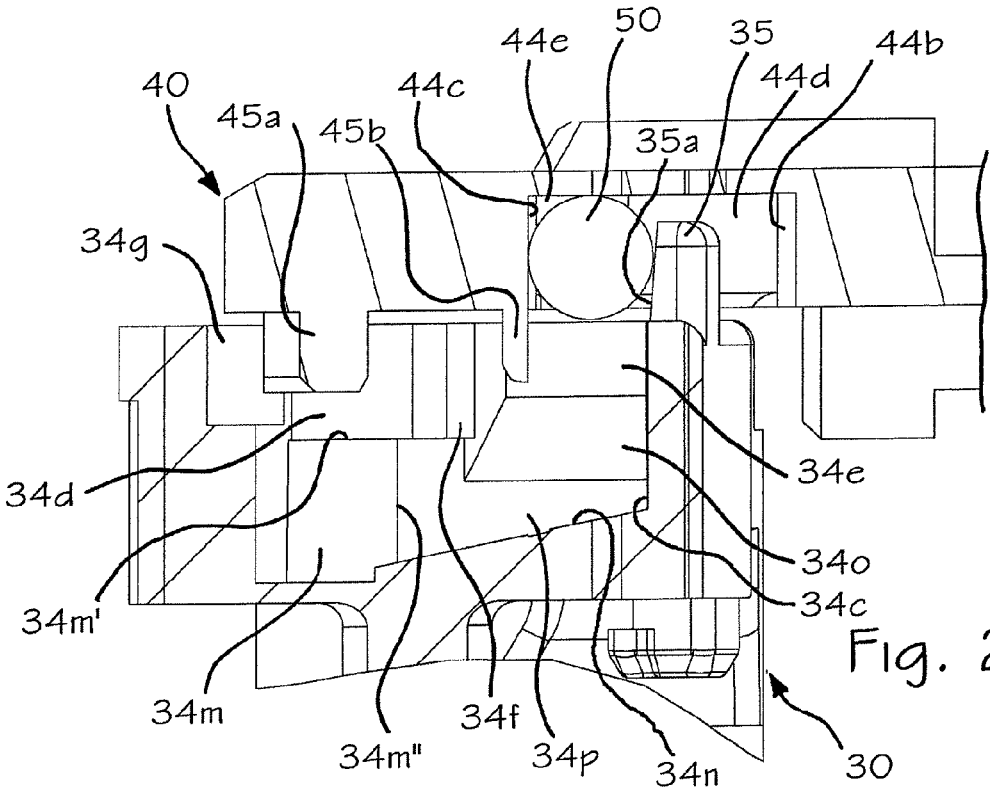

In the embodiment illustrated by way of example, and which at the moment is deemed to be preferential, the floating body consists of a ball, for example made of steel; still with reference to the example illustrated, seat 34 has a depth such as to be able to contain completely the body of ball 50 (see for example FIG. 10), while seat 44 has a depth such as to be able to contain for the most part the volume of ball 50 (see for example FIG. 22).

When assembled on the dispenser, the lever 30 and the rod 40 are arranged in such a way that the front surface 33 is facing and adjacent to the front surface 43. In this condition, at least part of seats 34 and 44 are facing each other, with projection 35 of lever 30 at least partly inserted within the seat 44 of rod 40, and with projections 45*a* and 45*b* of rod 40 at least partly inserted within seat 34 of lever 30, as is clearly visible for example in FIG. 10.

Figure 11:
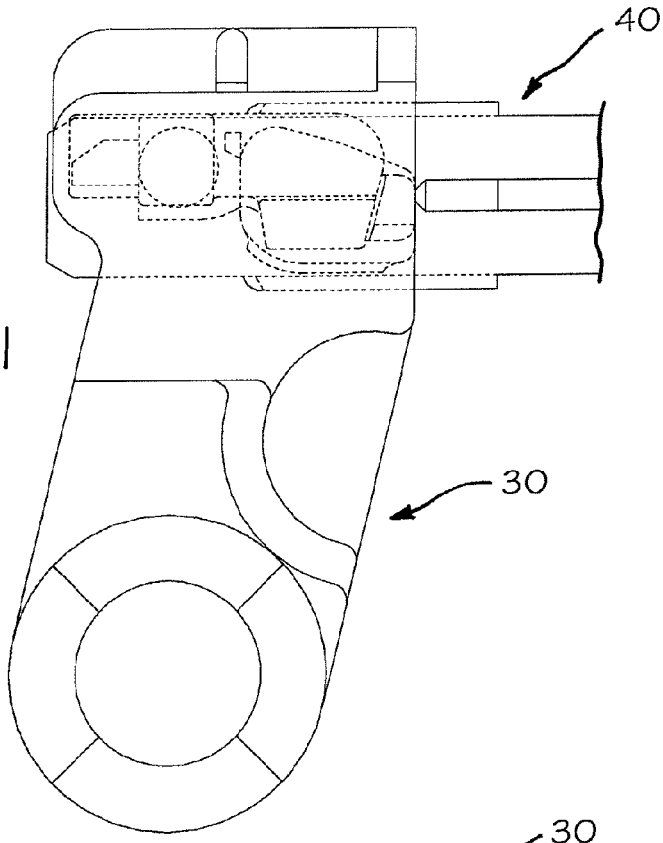
FIGS. 11 and 12 are a side view and a perspective view, partially sectioned and on a larger scale, respectively, of parts of the actuation device according to the invention, in a first condition.

In FIG. 10 the relevant parts of the actuation device according to the invention are represented in an inoperative initial or reset condition: with reference to the example of application to the dispenser 10, a dose of detergent has already been loaded into the corresponding compartment closed by lid 12, but with the door 4 of the dishwasher 1 still open (horizontal or inclined at a substantial angle), as in FIG. 1. The condition of the actuation device 17 with door 4 closed, and therefore substantially vertical, on the other hand, is represented, in a way limited to the parts concerned, in FIG. 14, in FIGS. 11 and 13 and in FIG. 12, in which lever 30 is partially sectioned at the seat 34. Note that, in reality, lever 30 and rod 40 are in an inclined position with respect to the vertical, as may be seen in FIG. 13: in FIGS. 11, 12 and 14 the components appear as if arranged vertically only because of requirements of greater clarity of representation.

Figure 12:
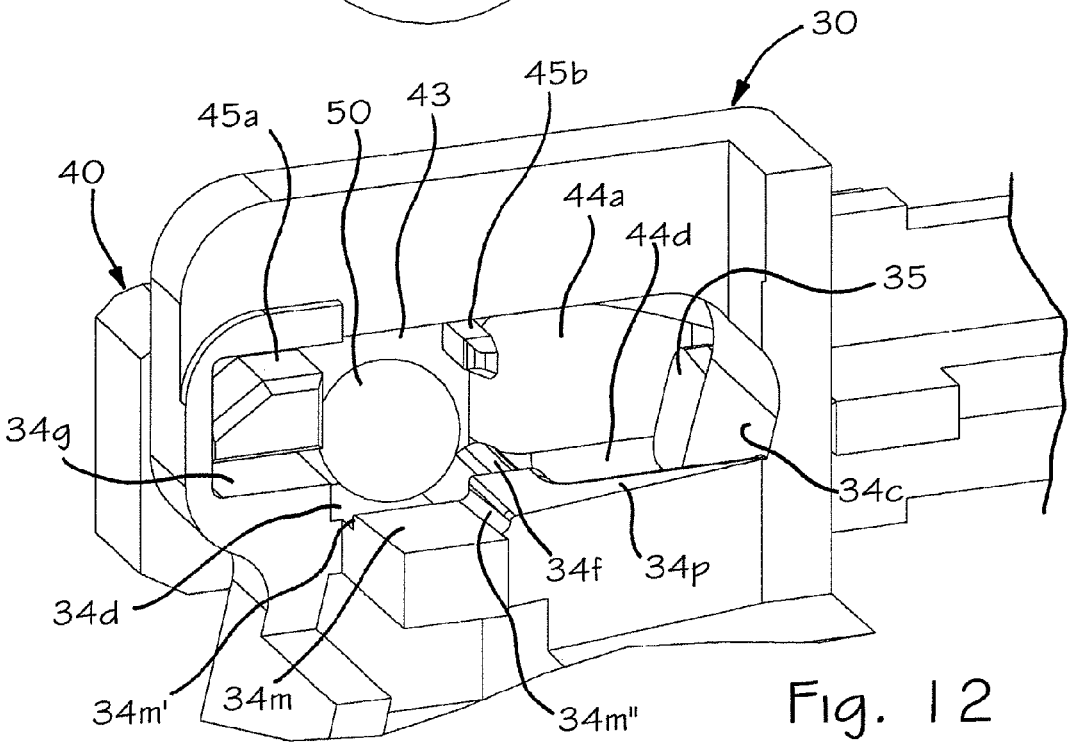
Figure 13:
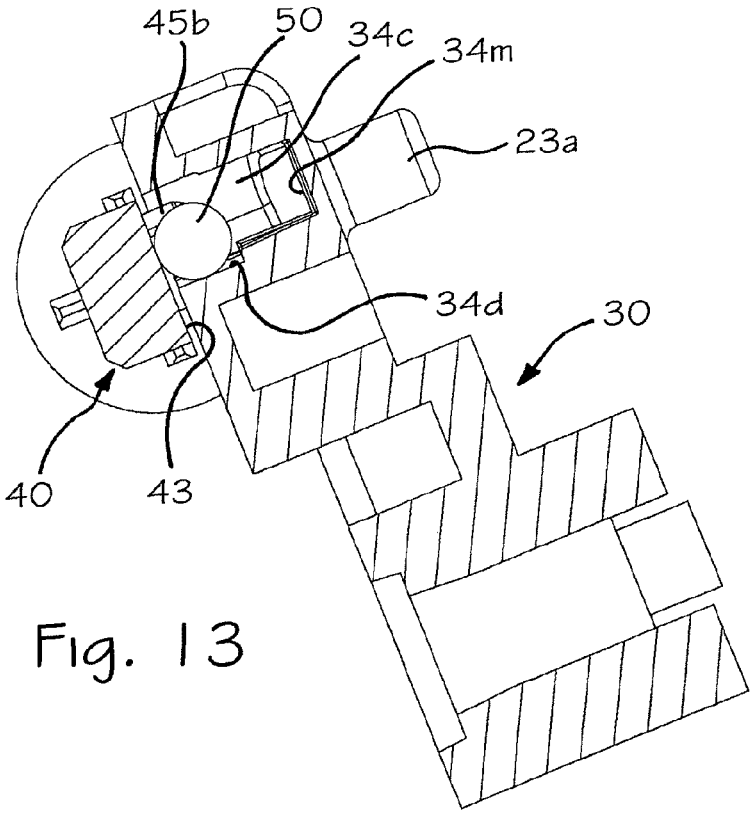
FIGS. 13 and 14 are schematic partial sections of FIG. 11, on different scales.
Figure 14:
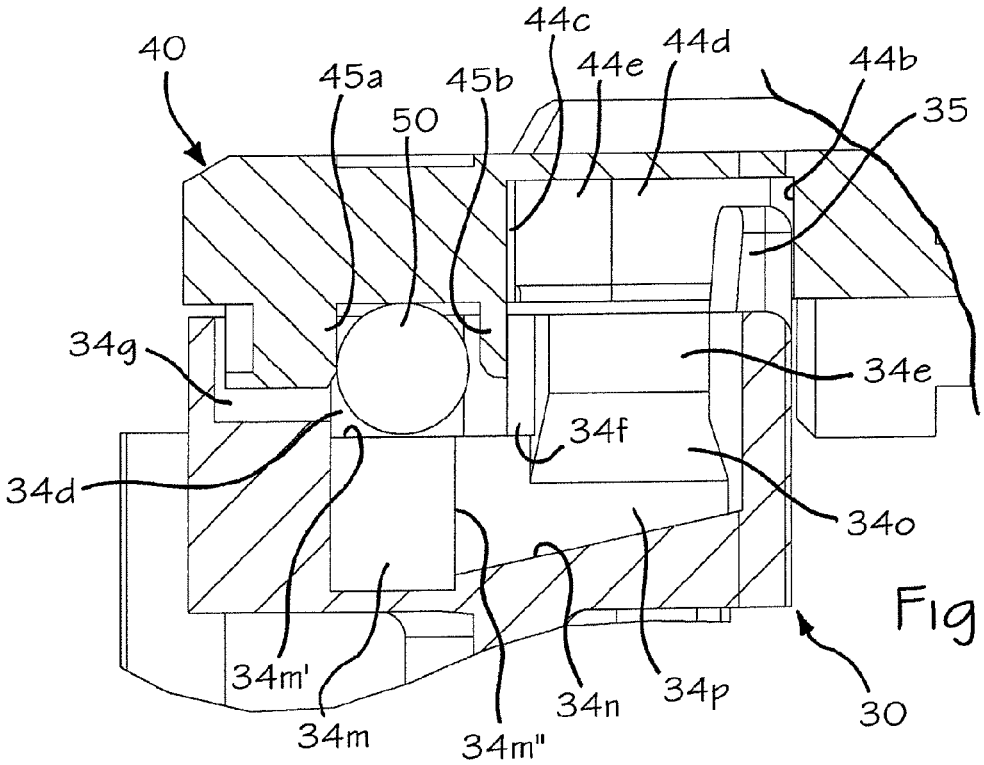
Figure 19:
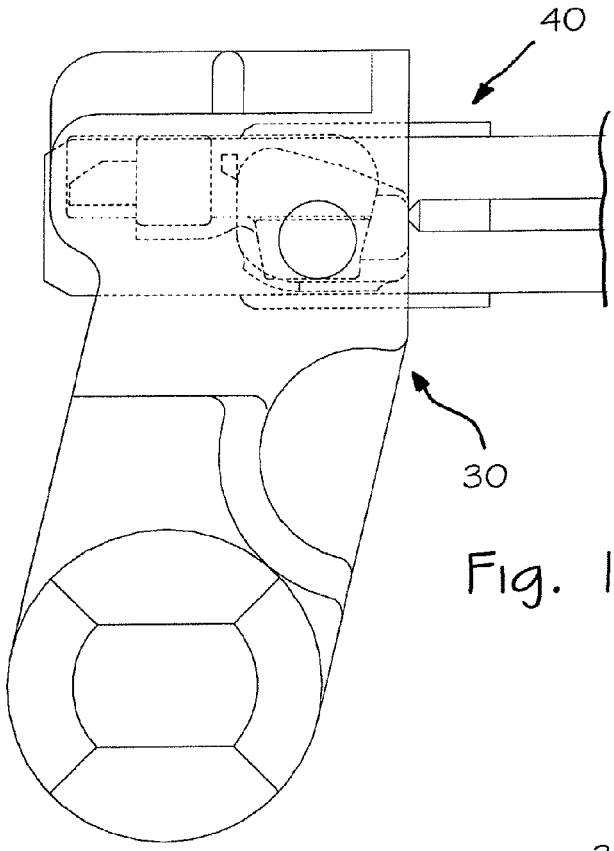
FIGS. 19-22 are views similar to those in FIGS. 11-14, but with the device in a third condition.

As may be inferred, particularly from FIGS. 12 and 14, in the initial condition, seats 34 and 44 partially face each other: in this connection note that the longitudinal development of seat 34 (to be meant as the distance between the two respective end surfaces, or length in the direction of the axis of the rod 40) is greater than the longitudinal development of seat 44.

The ball 50 is located for the most part within seat 34 of lever 30, and in particular rests on the lower surface portion 34*d*. Notwithstanding the inclination of the dispenser 10 (see FIGS. 2 and 13), and therefore of the actuation device, the ball 50 is prevented from moving into seat 44 because, in the condition under examination, the part of the front surface 43 of the rod 40 in which projections 45*a* and 45*b* are located is facing towards and adjacent to the area of seat 34 in which the ball 50 is located; because of the inclination of the actuation system, the ball 50 rests by gravity against the front surface 43, precisely in the space between the two projections 45*a* and 45*b*, as is clearly visible in FIG. 14.

At a certain moment of the washing cycle, when the solid detergent is to be delivered, the timer of the machine 1, controls power supply to the coil 21 (FIG. 5*a*), thus causing the retraction of the core 23 and the movement of the lever 30, as may be seen in FIGS. 15 and 16. In this way the shaft 15 (FIG. 5*a*) is made to rotate and the lid 12 of the dispenser 10 is released; the detergent is then free to fall by gravity into the inside of the washing chamber 3 of the machine 1. As a matter of fact, the angular movement of the lever 30 is not transmitted to the rod 40, because projection 35 is free to slide within seat 44, performing a maximum stroke, until it comes into contact or into proximity with the end surface 44*c*, as may be seen for example in FIG. 18. Alternatively, the system may be designed so that, as a result of the movement of the lever 30, the interaction between projection 35 and the end surface 44*c* of seat 44 causes a non-significant sliding of rod 40, i.e., of reduced size or in any way not sufficient to enable the delivery of the liquid additive (or other function which may be associated with the rod).

In the course of the movement of the lever 30, the hall 50 is constrained to lateral movement, because it is positioned between projections 45*a* and 45*b* of the rod 40, resting on the relative front surface 43. In this way, given that in this phase the rod 40 is static or substantially static, the lower surface of the seat 34 in the lever 30 can "slide" below the ball 50. In the course of the movement of the lever 30, the ball 50 can however rise slightly, given the upwards inclination of the lower surface portion which forms the cusp 34*f*.

At a certain point of the movement of the lever 30, the ball 50 overcomes the cusp 34*f*, and then falls towards the lower surface portion 34*e*. It should be noted that the surface of the step 34*f'* (FIG. 7) is preferably inclined towards the cusp 34*f*, or towards surface 34*d*, especially for the purpose of facilitating the fall of the ball 50 towards surface portion 34*e*; for preference, the inclination of surface 34*f'* is such as to avoid a return of the ball 50 towards the cusp 34*f*, or to create a means or constraint against accidental movements of the floating body and/or movements in the wrong direction.

As explained previously, portions 34*n* and 34*o* together form a section of the bottom of seat 34 having a curved and inclined profile, meeting up with the lower surface portion 34*e*; owing to the conformation of portion 34*o* and to the fact that components 30 and 40 are in an inclined position (FIG. 17), at the end of the stroke of the lever 30, the ball 50 is still maintained in a position where it is resting laterally against the front surface 43 of the rod 40, yet remaining for the most part within seat 34. The ball is also kept in the position which it has reached as a result of the presence of the step surface 34*f'* (FIG. 7). As will be noted, particularly in FIGS. 16 and 18, at the end of the stroke of lever 30, the two seats 34 and 44 are no longer partially facing each other, as it is now surface portion 43 of rod 40, carrying projections 45*a* and 45*b*, which is facing part of seat 34.

Figure 20:
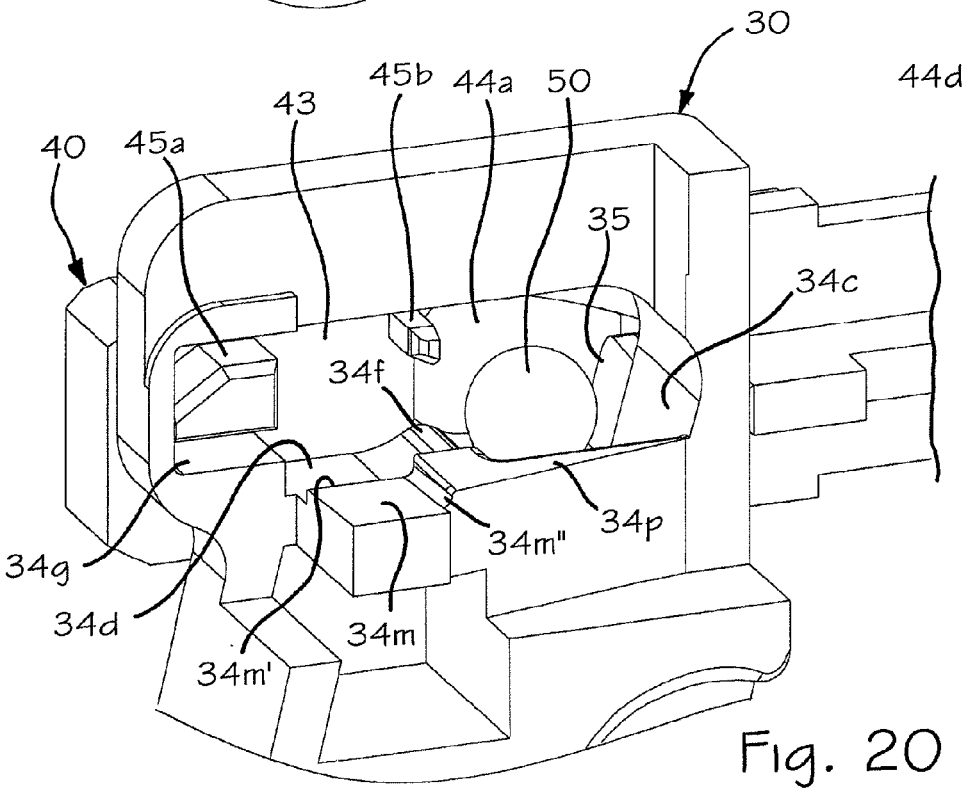
Figure 21:
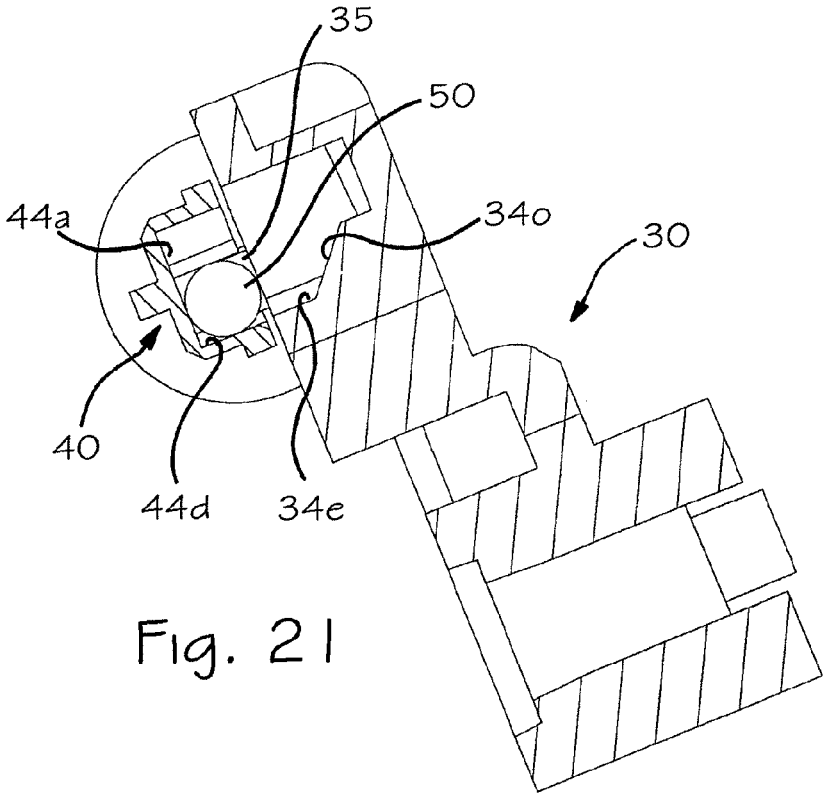

Upon cessation of the pulse of power supply to the coil 21, the core 23 and the lever 30 return to their respective initial positions, due to the action of the spring 18 (FIGS. 5*a* and 5*b*), as represented in FIGS. 19-22.1*n* this way the front surface 33 of the lever 30 and the ball 50 slide with respect to the front surface 43 of the rod 40, which is static, until seats 34 and 44 are once more partially facing each other, as may be seen for example in FIGS. 20 and 22. Given the inclined positioning of the device, and the possible presence of the ramp portion 44*f* (FIG. 9), the ball 50 is free to roll onto the lower surface portion 34*e* of seat 34 and then onto the lower surface portion 44*e* of seat 44, as may be seen in FIGS. 21 and 22, until it rests on the bottom 44*a* of seat 44. As a matter of fact, therefore, the ball 50 passes from seat 34 to seat 44, and the ball remains in the position which it has reached as a result of the inclination of the actuation device and/or of the dispenser 10.

At a subsequent moment of the washing cycle, when it becomes necessary to deliver a dose of rinse aid, the timer in machine 1 causes the coil 21 to be powered once again, thus bringing about a further retraction of the core 23 (FIGS. 5*a* and 5*b*) and another angular movement of the lever 30, as may be seen in FIGS. 23-26. In the course of the movement of lever 30, the respective projection 35 slides within seat 44 of the rod 40: however, unlike what happened in the course of the first actuation (FIGS. 15-18), in this phase the ball 50 is accommodated within seat 44, thus reducing the stroke permitted to projection 35 in the seat itself. In the course of its stroke, therefore, projection 35 moves until it meets the ball 50, and then shifts the ball along seat 44, making it move or climb along the lower surface portion 44*e* (FIG. 9). At a certain point the ball 50 conies to rest, on one side, against the end surface 44*c* of seat 44 and, on the opposite side, a thrust is exerted upon it by projection 35 of lever 30 which is moving. As previously noted (see FIG. 10), the active surface 35*a* of projection 35—i.e., the surface cooperating with the ball 50—exhibits for preference an inclination, however slight, with respect to surface 34*c*, so as to facilitate thrusting the ball 50 towards element 40, at the same time avoiding the ball itself moving laterally towards seat 34. In particular, owing to this slight inclination of surface 35*a*, projection 35 can thrust the ball as far as the corner delimited by surfaces 44*c* and 44*e*, without the risk of the ball receiving a component tending to make it jump out of its working position, towards the inside of seat 34 (in practice, as may be inferred from FIG. 26, in the phase under consideration, surface 35*a* of projection 35 is not parallel to surface 44*c*).

It is evident that, unlike in the previous actuation, part of the angular movement of lever 30 in this case is transferred to rod 40, with a resulting linear translation of the latter. As may be inferred, the magnitude of this translation is a function of the overall dimensions of the ball 50 (obviously, as well as of the shape and dimensions of seats 34 and 44 and of projection 35). The movement of rod 40 thus brought about causes the activation of the valve device 16 for the rinse aid delivery arrangement, the result being the emission, from opening 14 of FIG. 3, of a dose of liquid washing agent into the washing chamber 3 of the machine 1.

In this case, too, on the cessation of the supply to the coil 21, the core 23, the lever 30 and the rod 40 will return to their respective rest positions, by virtue of the action of the spring 18, so arriving at a position similar to that of FIG. 20 or 22. The ball 50, remaining within seat 44, will roll backwards onto the lower surface portion 44*e*, particularly until it comes to rest against projection 35, as in FIG. 22.

Naturally, if the washing cycle selected provides for one or more deliveries of rinse aid, the coil 21 will be powered again, causing the actuation system 17 to operate in a way similar to that described with reference to FIGS. 23-26, with a consequent actuation of rod 40 on each excitation of the coil 21.

The resetting or rearming of the actuation system 17 to the initial condition shown in FIGS. 11-14 is achieved after the conclusion of the washing cycle, when the user of the machine 1 opens the door 4, bringing it for example to the position visible in FIG. 1 (see also FIG. 10 in this connection).

At the end of the washing cycle, scats 34 and 44 are partially facing each other (see FIG. 22): as may be inferred, therefore, in the course of the tilting of the door 4 to the open position, the seats come to a position where one overhangs the other, in particular with seat 44 of rod 40 above seat 34 of lever 30, and with ball 50 thus being able to freely pass or fall by gravity from the former to the latter. In particular, the ball 50 moves from the lower surface portion 44*d* of seat 44 onto the lower surface portion 34*e* of seat 34, and then rolls onto the bottom portions 34*o* and 34*n* of seat 34 which, as has been recalled several times, form a curved and inclined profile. Thanks to this shape, the ball 50 is therefore induced to roll as far as the recess 34*m* at the bottom of seat 34, as may be seen in FIG. 10, and remains engaged therein. In this phase, when the ball 50 overcomes the step 34*p*, the step itself and the inclination of the bottom portion 34*n* guide the ball precisely as far as the inside of the recess 34*m*; once it has reached the inside of recess 34*m*, the ball 50 obviously cannot move back again onto the bottom portion 34*n*, because of the presence of the step 34*m*".

In the course of the subsequent closure of the door 4, the ball 50 will be prevented from passing into seat 44, due to the presence of the recess 34*m*, and of the step formed between the recess itself and the bottom portion 34*n*, the cusp 34*f* and the projection 45*b*. Note in this connection that, in the course of the movement of the door, the ball is induced to pass, by gravity, from the recess 34*m* to the lower surface portion 34*d* of seat 34, precisely because it is guided by means of the recess 34*m*. Once it has reached lower surface portion 34*d*, the ball 50 cannot move to left or right, with reference to FIG. 10, given the presence of projections 45*a* and 45*b*. The components have thus returned to the conditions of FIGS. 11-14.

In the case of the illustrated example of use, it can happen that a user of the machine 1 momentarily interrupts a washing cycle that is in progress by opening the door 4, for example in order to add dishes to the machine, and this could theoretically make part of the actuation cycle of device 17 ineffective. As explained in WO 2007/017749, however, the machine's control system can easily be configured to detect an opening of the door, and consequently control at least one additional actuation of actuator 20, with the aim of bringing the actuation system 17 into a correct condition for the purpose of delivering the washing agent at the appropriate moment.

As has been previously mentioned, the actuation system 17 can be designed such that, even following the first actuation of the actuator 20, a limited part of the movement of the lever 30 is transferred to the rod 40, i.e., with the driven member being able to perform a certain stroke, of limited magnitude compared with that obtainable following a subsequent activation of the actuator 20, and anyway not sufficient to cause the delivery of the rinse aid. Such an implementation simplifies the manufacture of the device, in terms of production and assembly tolerances.

The embodiment of the invention exemplified above presupposes, for its operation, a certain degree of inclination of the dispenser and of the actuation device 17. It is however clear that the device 17 as a whole and/or components 30 and 40 and/or seats 34 and 44 can be configured to allow the device itself to operate in other possible orientations, and particularly an orientation where the reclined position of the device is substantially horizontal and the erect position of the device is substantially vertical. The simplest way, for example, is to form or mount the actuation device 17 and/or the components 30 and 40 with respect to the casing 11 of the dispenser with a slightly inclined configuration, in the direction desired for producing the effects described above. Another possibility is to use a general solution of the type described with reference to FIGS. 22-38 in WO 2007/017749, to which reference can be made.

The invention has been described with reference to use thereof in combination with a dispenser of washing agents for a dishwasher, but it is clear that the actuation device is adapted of use in other ways. For example, the device according to the invention can be combined with a detergent drawer of pull-out type for a clothes washing machine, as described in WO 2007/017749, or with a detergent distributor mounted on the door of a top-loading clothes washing machine, so as to exploit directly the typical movement of the door itself—horizontal when closed, vertical when open—to obtain the rearming or resetting of the device according to the invention. The invention is also clearly capable of application in other fields than that of domestic electrical appliances, which are here mentioned solely for illustrative purposes.

The description given above makes clear the features and the advantages of the present invention, which are mainly represented by the compactness of the kinematic arrangement that couples together the members of the actuation system, the simplicity of manufacture of its components, and the substantial absence of mechanical wear between the interacting components. A substantial advantage of the invention is that maintenance of the correct position of the floating body 50 is always guaranteed.

As seen, in the example of application described, the driving member 30—which is capable of performing angular movements—drives a first mechanism 15 and the driven member 40—which is capable of performing linear movements—drives a second mechanism 16. The driving member 30 and the driven member 40, or rather the respective seats 34 and 44, are arranged or shaped in such a way that at least one movement of the floating member 50 from one seat to the other occurs in a selective or controlled manner, particularly:

- depending on the mutual position assumed by respective portions of the seats 34 and 44 following an activation of the actuating means 20, and therefore following a relative displacement between the driving member 30 and the driven member 40, and/or
- following a variation of the angular position of the device 17.

In the operation of the device the floating body 50 moves in practice along a "closed path", defined in part by seat 34 and in part by seat 44. This path is followed partly as a result of activations of the device 17 and partly as a result of a movement of the device itself, or a variation of its lying position. Along the said path, the floating body 50 assumes sequentially a plurality of different positions, even within the confines of a single seat, with the constraint means represented by the elements marked 34*m*, 34*m*', 34*m*", 34*p*, 45*a* and 45*b* guiding the movement of the body itself between these sequential positions and/or preventing accidental or irregular displacements of the floating body 50. For example, as seen above, at least some of the aforesaid constraint means are configured for guiding successive movements of the floating body 50 within the confines of seat 34, preventing it from making undesired movements.

The driving member 30 and the driven member 40, or rather the respective seat 34 and 44, are also arranged or shaped such that, following an activation of the actuating means 20:

- with the floating body 50 in seat 44, the driven member 40 performs a first stroke, and
- when the floating body 50 is in seat 34, the driven member 40 performs a second stroke, of lesser magnitude than the first stroke, or remains substantially motionless.

The driving member 30 and the driven member 40, or rather the respective seats 34 and 44, are further arranged or shaped such that:

- in the course of an activation of the device 17, with the floating body 50 in seat 34, the engagement part 35 can perform a maximum stroke within seat 44, in such a way as to
- cause a transfer of first magnitude of the movement of the driving member 30 to the driven member 40, or
- cause a non-significant transfer of the movement of the driving member 30 to the driven member 40, or
- not cause a transfer of the movement of the driving member 30 to the driven member 40; and
- in the course of another activation of the device 17, with the floating body 50 in seat 44, the engagement part 35 can perform only a limited stroke within seat 44, so as to cause
- a transfer of second magnitude of the movement of the driving member 30 to the driven member 40, or
- a significant transfer of the movement of the driving member 30 to the driven member 40.

As said, in the example described, the actuation device is associated to a structure 4 which is angularly movable between a reclined or lowered position and an erect or raised position, and the driving member 30 and the driven member 40, or rather the respective seats 34 and 44, are arranged or shaped such that

- with the floating body 50 in seat 44, a movement of the structure 4 between the erect position and the reclined position causes the movement by gravity of the floating body 50 from seat 44 to seat 34, and
- a movement of the floating body 50 from seat 34 to seat 44 occurs by gravity, following an activation of the actuating means 20.

Practical tests carried out by the applicant have allowed to verify that the actuation device described above enables the aims of the invention to be effectively achieved.

In particular, provision of the constraint means represented by the projections or reliefs 45*a* and 45*b* enables the maintenance of a substantially predetermined position of the floating body 50 to be guaranteed, in the event of one or more potentially critical situations. When it is brought into the initial condition (FIGS. 10 and 11-14), for example with a violent closure of the door 4 of the dishwasher 1, the floating body 50 is prevented from being accidentally displaced along seat 34, and therefore towards seat 44, precisely because of the presence of projections 45*a* and 45*b*, which guide its movement within the confines of seat 34. Note, however, in this connection that even the presence of projection 45*b* only is sufficient for this purpose.

In the course of such a closure of the door 4, also the recess 34*m* embodies a constraint means, in the sense that it guides the floating body 50 unequivocally precisely in the region between the projections 45*a* and 45*b*. Also the step 34*m*' formed between recess 34*m* and surface portion 34*d* (see FIG. 7) creates a constraint means for the floating body 50, preventing it from making an irregular or undesired movement, or moving back or returning from surface 34*d* towards the inside of recess 34*m*; similarly, step 34*m*" prevents irregular or undesired movements of the floating body 50 from recess 34*m* onto surface portion 34*n*.

Projections 45*a* and 45*b* allow control of the maintenance of the correct position of the floating body 50 in the course of the first actuation of the device (FIGS. 15-18), particularly in the event that the actuator used is of the type which imparts a particularly sharp angular movement to the lever 30.

Even following the return of the lever 30 to the starting position and in the condition following the first actuation (FIGS. 19-22), the operation of the device 17 is immune to knocks or vibrations, because the presence of projection 45*b* and the particular conformation of the bottom of seat 34 prevent displacements or undesired variations of position for the floating body 50. The same can be said as regards the second phase of actuation (FIGS. 23-26).

From the description given it is also possible to observe that, in addition to a different conformation for the seats in the driving member and the driven member, the device according to the invention is distinguished from the known art mentioned earlier also in respect of the different position of the hall at the start of the operating cycle, or in the system's reset phase. As will be appreciated for example from FIGS. 10 and 14, in fact, in the course, and at the end of the reset phase, the area of seat 34 in which the floating body 50 is located already faces a portion of the front surface 43 of the driven member 40: this in itself limits the risk that the floating body can assume undesired or irregular positions as a result of significant knocks suffered by the actuation device (for example, moving into seat 44). Also during the course of the first actuation (see FIG. 16), in front of the floating body 50 there is still part of the front surface 43.

It must finally be emphasised that in cases where projection 45*a* of the driven member 40 is provided, it also plays an active part in causing the floating body 50 to overcome the cusp 34*f*. Owing to this characteristic, therefore, the actuating means on the device do not necessarily have to be of the type suitable for imparting a quick, sharp movement: consequently the actuating means could consist of a thermoelectric actuator or thermoactuator.

It is clear that for a person skilled in the art, numerous variants are possible to the dispenser described as an example, without for this reason departing from the scope of the invention as defined in the claims which follow.

In accordance with one possible variant, the device according to the invention is designed to be fixed or mounted on a fixed element, or one which is designed to remain permanently in a vertical or near-vertical position, or without variations in lying position. In this variant, in order to cause the movement of the ball 50 from seat 44 to seat 34, means are operatively associated with the device 17 (for example a permanent magnet or an electromagnet) for generating a magnetic field suitable, by means of magnetic attraction or repulsion, for inducing a displacement of the floating member 50, as described in WO 2007/017749.

The front surfaces 33 and 43 of members 30 and 40 do not necessarily have to be flat, and could possibly be complementary to each other, and therefore could be of different shapes from each other (for example a surface with a convex profile which slides over a surface with a concave profile); in general terms, therefore, it is sufficient that surface 33 and 43 should be capable of slidingly cooperating with respect to each other.

Projection 35 of lever 30 and projections 45*a* and 45*b* of rod 40 could naturally have shapes and layouts different from what is pictured by way of example, while still fulfilling the functions described.

The invention claimed is:

1. An actuation device comprising a driven member, a driving member, and actuating means operable for producing a movement of the driving member, wherein a first of said members has a first seat into which an engagement part belonging or associated to a second of said members is at least partially inserted, and wherein the second of said members has a second seat which, in at least one condition of the actuation device, at least partially faces the first seat, the actuation device further comprising at least one floating body, capable of displacement between the two seats when they are at least in part facing each other, following successive actuations of the actuating means and/or movements imparted to the device, and constraint means configured for preventing accidental or irregular displacements of the floating body, particularly accidental or irregular movements due to knocks, vibrations and similar mechanical stresses, wherein said constraint means comprises;

first constraint means belonging to the first of said members, the first constraint means being operatively inserted, with possibility of relative movement, into the second seat and comprising two projections of the first of said members, the two projections identifying between them a constraint region for the floating body in at least one condition of the device.

2. The device according to claim 1, wherein the first and the second seat are substantially configured as blind cavities.

3. The device according to claim 2, wherein the first seat has a bottom and a peripheral profile comprising an upper surface, two longitudinal end surfaces and a lower surface.

4. The device according to claim 3, wherein said lower surface of the first seat has a first region and a second region differently inclined to each other.

5. The device according to claim 2, wherein the second seat has a bottom and a peripheral profile comprising an upper surface, two longitudinal end surfaces and a lower surface.

6. The device according to claim 5, wherein said lower surface of the second seat has a first region and a second region between which a cusp is formed.

7. The device according to claim 6, wherein said first region of the lower surface of the second seat extends to a greater height than the second region of lower surface of the second seat and the recess of the bottom of the second seat is substantially aligned with said first region.

8. The device according to claim 5, wherein said bottom has at least one curved region.

9. The device according to claim 5, wherein in said bottom of the second seat there are formed at least one of a recess and a plurality of steps.

10. The device according to claim 2, wherein each member has a front surface at which the respective seat opens, where in particular the front surface of one member is configured for slidingly cooperating with the front surface of the other member.

11. The device according to claim 10, wherein the driven member and the driving member, or the respective seats, are arranged or shaped such that, in each operating position of the device, a region of the front surface of the first member faces a respective portion of the second seat.

12. The device according to claim 10, wherein the driven member and the driving member, or the respective seats, are arranged or shaped such that, in the course of or at the end of a reset phase of the device, a region of the front surface of the first member faces a portion of the second seat in which the floating body is temporarily positioned.

13. The device according to claim 2, wherein the second seat has at least variable depth, or has a bottom surface at least in part inclined.

14. The device according to claim 1, wherein said first constraint means project from a front surface of the first member.

15. The device according to claim 14, wherein the driven member and the driving member, or the respective seats, are arranged or shaped such that, in a position of operation of the device, a region of the front surface of the first member from which project the said first constraint means faces a respective portion of the second seat.

16. The device according to claim 1, wherein the floating body has a substantially spheroidal form.

17. The device according to claim 1, wherein the constraint means are configured to guide sequential movements permitted to the floating body within the second seat, preventing it from making accidental or irregular movements.

18. The device according to claim 1, wherein the floating body is capable of assuming a plurality of sequential positions within at least one of said seats following successive activations of the actuating means or movements imparted to the device, and the constraint means are configured to guide displacement of the floating body between said sequential positions, preventing it from making accidental or irregular displacements.

19. The device according to claim 1, wherein each seat has dimensions such as to be able to receive at least in predominant measure the floating body and allow it at least one displacement according to a longitudinal extension of the seat itself.

20. The device according to claim 1, wherein said constraint means further comprises;

second constraint means belonging to the second of said members, the second constraint means comprising at least one of:

a recess formed in a bottom of the second seat, the recess identifying a constraint region for the floating body in at least one condition of the device, and two or more steps formed within the second seat.

21. The device according to claim 1, wherein said second constraint means are formed in a bottom of the second seat which is opposed to a front surface of the second member.

* * * * *